United States Patent [19]

Campbell et al.

[11] 4,431,124

[45] Feb. 14, 1984

[54] APPARATUS AND METHOD FOR GUIDING METAL STRIP

[76] Inventors: Thomas S. Campbell; Robert E. Campbell, both of R.D. #1, Terri Dr., West Middlesex, Pa. 16159

[21] Appl. No.: 384,872

[22] Filed: Jun. 4, 1982

[51] Int. Cl.[3] ..... B65H 25/26

[52] U.S. Cl. ..... 226/15; 226/3; 226/30; 226/170; 242/78.7

[58] Field of Search ..... 226/15, 17, 3, 27, 29, 226/30, 170; 242/78.1, 78.6, 78.7; 198/824–828

[56] References Cited

U.S. PATENT DOCUMENTS 3,225,992 12/1965 Ungerer ..... 226/170

*Primary Examiner*—Leonard D. Christian

*Attorney, Agent, or Firm*—Parmelee, Miller, Welsh & Kratz

[57] ABSTRACT

Belt-like traveling guide apparatus has been provided for guiding side edges of metal strip material that is being positively advanced from, for example, an uncoiling station to a second or processing station. Side pairs of idler guide rolls are employed for maintaining the material in a planar relation during its movement, and idler head and tail and upper and lower guide rollers are employed for maintaining one side face of each of a pair of continuous belts in synchronized movement engagement with opposite side edges of the material to thereby protect them and, at the same time, positively and accurately align the material during its forwardly advancing movement between the stations.

16 Claims, 6 Drawing Figures

A
B
C
D
E
a
b
10
11
12
12a
15
15a
16
18
19
20
20'
21
21'
26
26'
28
29
II
IV
V
VI

APPARATUS AND METHOD FOR GUIDING METAL STRIP

BRIEF SUMMARY OF THE INVENTION

This invention pertains to the guided feeding of strip material from a first apparatus station such as an uncoiling station into a processing second apparatus station in such a manner as to avoid damage to the material and, at the same time, to positively enter it in a fully aligned relation into the apparatus of the second station.

BRIEF DESCRIPTION OF THE INVENTION

In the art of metal forming and especially in that branch of the art dealing with thin metal sheeting or strip that is to be taken off a coil or fed from one station to advance it to a second or forming station, it is important to provide guiding means that will accurately align and maintain the material during its advance in such a manner as to prevent edge damage to or distortion of the material. This problem becomes increasingly acute with decreasing thicknesses of the material being processed, and also when the material has been painted or otherwise finished.

Presently used guiding means for thin metal material, particularly for off-the-coil forming, does not provide adequate protection in this connection. At the present time, guiding means employed utilizes stationary planar or flat elements adjacent and in close proximity to the moving edges of the material. Control is effected by actual contact made between the edges of the material and the guides. Although this is a correct guiding relation, it results in a rubbing-wearing frictional action on the edges of the strip or sheet material and in some cases, in damaging tears or deformation of the material. The wearing action also adversely effects the guides, themselves, and manifests itself in the form of grooves formed along their faces. Since the guide surfaces must be in close proximity to the edges, grooves worn therein destroy the proper relation and thus, the guides must be frequently replaced. Also, the guide surfaces must be of a material of not too great a hardness to avoid excessive wear and tear on the strip material. Guide wear not only contributes to lower protection but to higher production costs.

There has thus been a need for a new and improved type of approach to the problem of accurately guiding the strip material in such a manner as to minimize wear and tear, not only on the edges of the material but also on the guide means employed.

It has thus been an object of my invention to provide a new approach to the guiding of moving strip material.

Another object has been to develop a method of guiding the material that will accurately maintain the advancing material in a properly and accurately guided relation and to do so without damaging the material and with substantial elimination of wear on the guiding means.

These and other objects of the invention will appear to those skilled in the art from the illustrated embodiment.

Figures 1, 2:
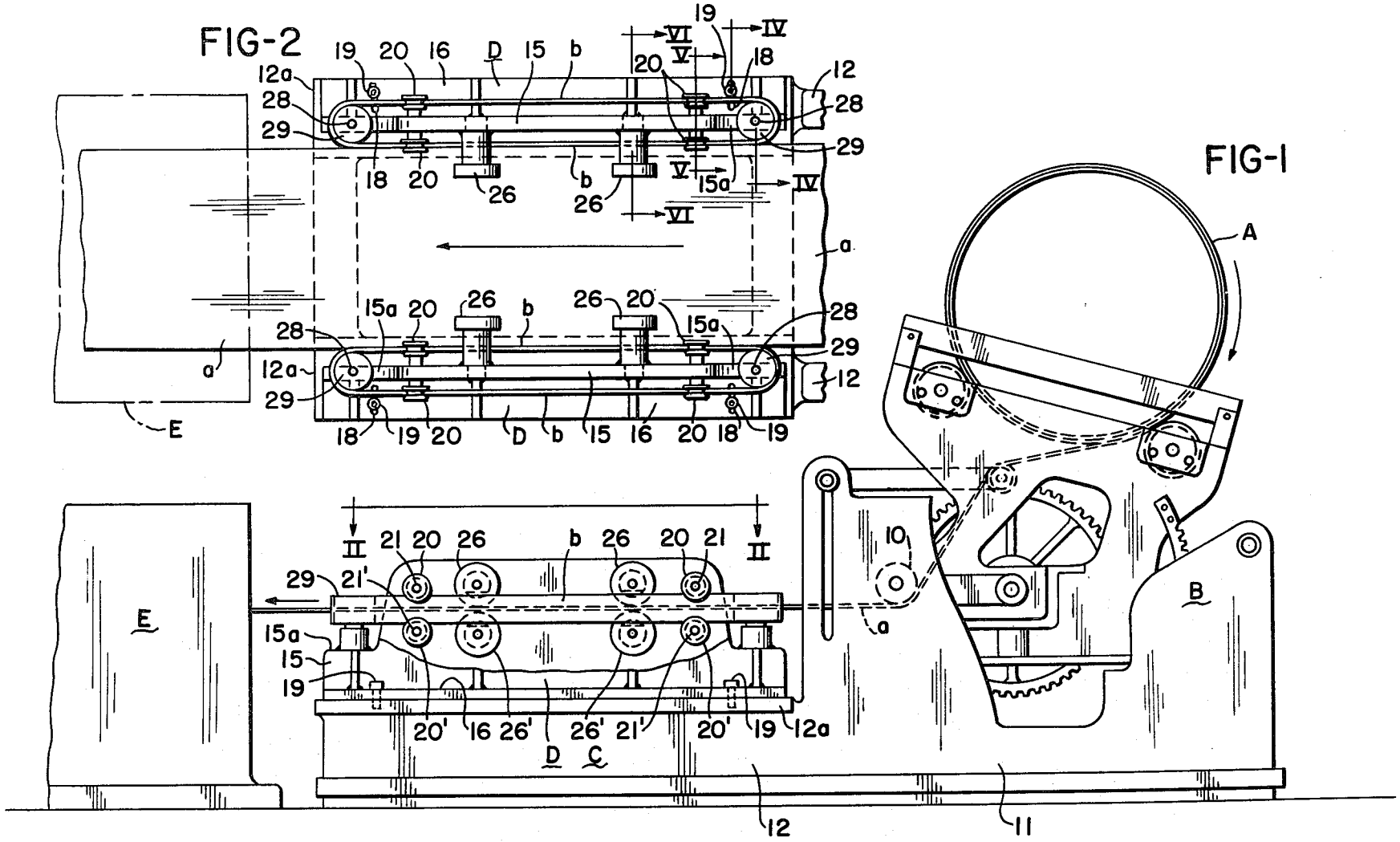
FIG. 1 is a side view in elevation of an operating apparatus arrangement employing the principles of the invention, showing strip material being fed from an uncoiling station along a guiding station or guided advancing planar area into a second or processing station, such as a roll forming station.
FIG. 2 is a fragmental plan view on the scale of FIG. 1, taken along the line II—II of FIG. 1, and particularly showing the guide apparatus construction on the invention.

Referring particularly to FIGS. 1 and 2 of the drawings, a coil of strip or sheet metal material A is shown in an uncoiling position at a first station represented, for example, by a conventional uncoiler B having a suitable frame structure 11. Length portions of strip material a may be fed from the station B, under a cross-extending roll 10 that is carried thereby, and in a straight, substantially planar advancing relation along and between a pair of upright guide units D, and accurately into a second processing station E, such as a roll forming station.

Figure 3:
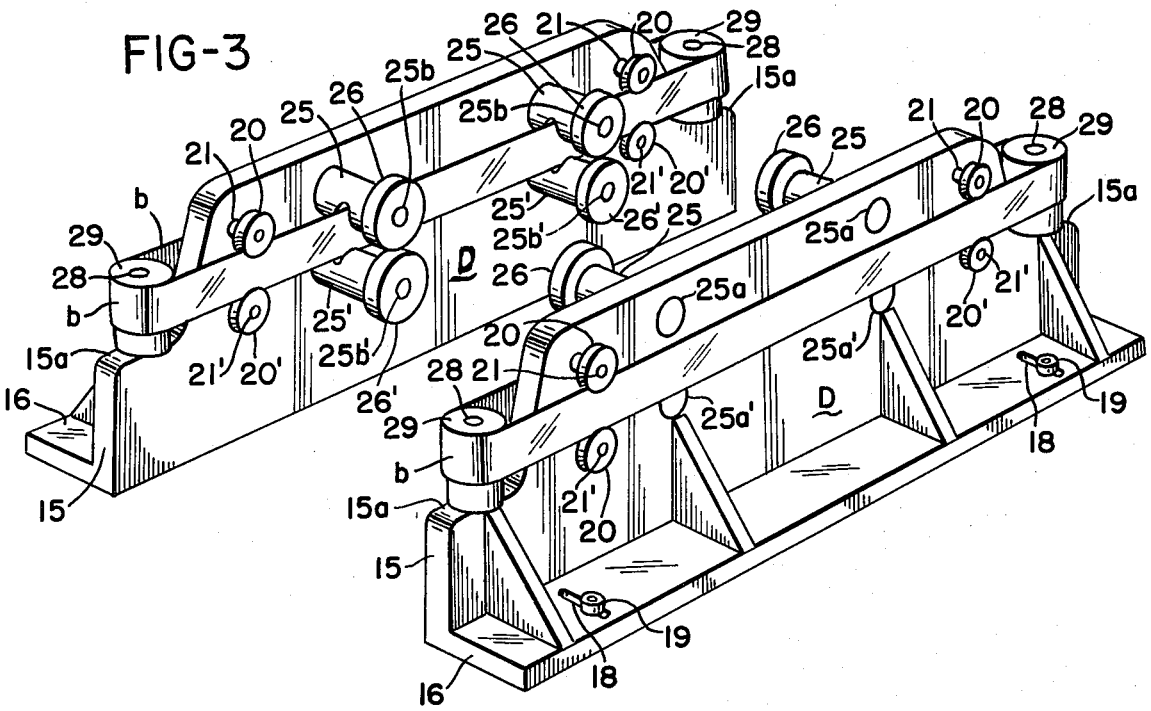
FIG. 3 is a perspective view of a pair of belt guide units of the construction of FIGS. 1 and 2 and on a slightly enlarged scale with respect thereto; as will be noted, these units are adapted to be adjustably mounted on a stationary base frame that is interposed between the strip processing stations.

Referring also to FIG. 3, each guide unit D of the pair is of similar construction and has an angle-shaped, upright side bracket or frame 15 that extends longitudinally between the stations B and E. An upright, pulley carrying wall of the frame 15 terminates in a support flange or foot portion 16. The flange portion 16 has a pair of longitudinally spaced-apart, transversely elongated, guide slots 18 therein for adjustably receiving mounting bolts 19 that are threadably secured on an upper mounting flange or platform portion 12*a* of a longitudinally extending, stationary base frame C. The base frame C has a pair of transversely spaced-apart vertical walls 12 that terminate in the mounting flanges 12*a* upon which the flanges 15*a* of the two units D rest and are adjustably secured.

Referring particularly to FIGS. 1, 2, 3 and 5, each guide unit D has upper and lower 20, 20' pairs of idler rollers, pulleys or elements that are rotatably mounted on opposite ends of through, cross-extending, fixedly secured supporting shafts 21, 21'. The rollers 20, 20' serve as opposed guide pairs along inner and outer sides of the upright wall portion of each bracket 15 for a continuous guide belt b. It will be noted from FIG. 5 that the pairs of upper and lower rollers 20 and 20' are centrally grooved or rounded-out along their peripheries to facilitate retention of each guide belt b in a properly aligned relation during its movement.

Figure 6:
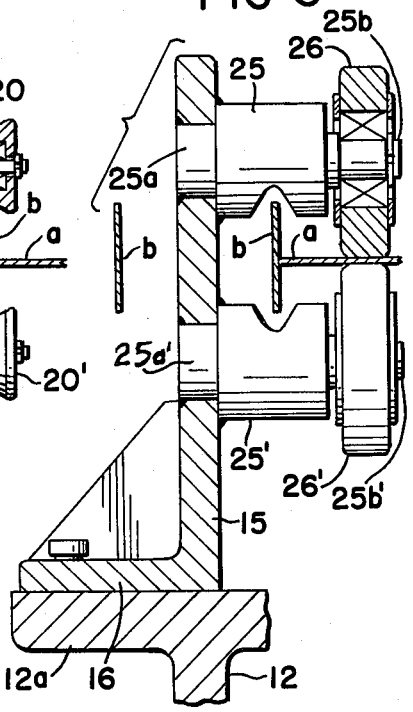

As shown particularly in FIG. 6, inside mounted pairs of upper and lower stationary guide bezels, knobs or elements 25, 25' are secured to extend transversely inwardly from the inside of the upright wall of each bracket or frame 15 by means of stub shafts 25*a*, 25*a'*. Each guide bezel 25, 25' has a central, V-shaped slot in its inner side to freely bypass upper and lower edges of each continuous guide belt b. Innermost ends of the pair of guide bezels 25, 25' carry projecting pin shafts 25*b*, 25*b'* that extend inwardly therefrom and rotatably journal a pair of upper and lower idler rollers 26, 26'. As particularly shown, the rollers 26 and 26' have relatively flat, smooth peripheral surfaces to define a guide pass for upper and lower faces of the strip material a that is being advanced between the stations. As will be noted, the outer edges of the strip material a are adapted to lie in abutting engagement substantially centrally of the adjacent guide belt b to thus impart movement thereto corresponding to the advancing movement of the strip material a.

Figure 4:
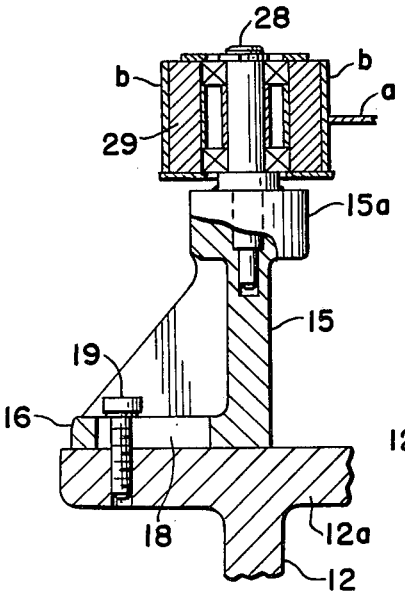
FIGS. 4, 5 and 6 are further enlarged fragmental sections in elevation taken respectively along lines IV—IV, V—V and VI—VI of FIG. 2 of the drawings.
Figure 5:
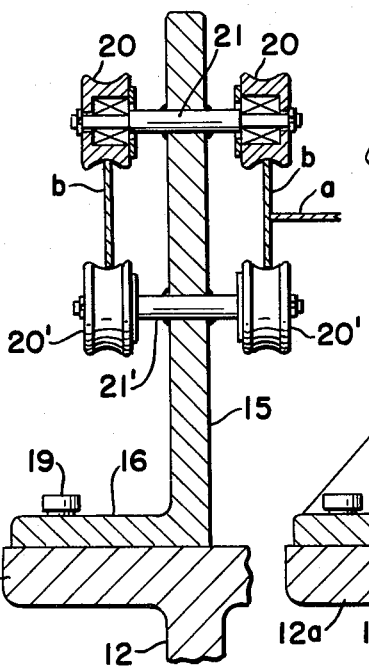

Referring to FIGS. 3 and 4, the opposite ends of each upright wall part of each bracket form 15 has an inwardly, downwardly indented or cut-out ledge portion 15*a*. Such ledge portion 15*a* terminates in a mounting boss 15*a* which securely carries an upwardly or vertically extending pin shaft 28. Each shaft 28 rotatably journals thereon on an upwardly extending, end-positioned, head or tail roller or pulley 29. End-positioned, upright-extending head and tail pulleys 29 guidably carry and reverse the direction of movement of each continuous guide belt b, as frictionally induced by a driven, forwardly advancing movement of the strip material a that is being processed.

It is thus apparent that the pulleys or roller pairs 20, 20' and 26, 26', as well as the head and tail pulleys 29 are free turning, as effected by movement of each side-positioned and longitudinally extending, continuous belt b. Movement of the belts b is, itself, accomplished by the guiding engagement of such belts along side edges of the strip material a as it is being advanced or pulled into the processing station E. A reinforced, accurate, planar advancement of the strip material a is assured by the pass provided by the pairs of upper and lower idler rolls 26, 26' (see FIGS. 1 and 6).

The arrangement thus assures full and even alignment between the guide belts b and the strip material a and a continuous and accurate guiding of the strip material, as effected by the belt. Adjacent strip passes are defined by the pairs of idler rollers 26 and 26' that are, as shown particularly in FIG. 3, positioned adjacent to the upper end lower pairs of guide rollers or pulleys 20, 20' for each of the guide belts b. There is little, if any, slippage between the strip material a and the belts b during its forward advance. At the same time, an accurately guided relation is attained, principally by the effective use of the engaged continuous guide belts b. Since the rollers or pulleys employed are all journaled for movement with the advancing movement of the strip material a, wear and tear upon the guide elements is minimized and damage to edges of the material a is substantially eliminated. Engagement is a freely moving type between the strip material being positively fed from station B to station E. At the same time, an effectively enabled positive guiding of the material is attained between stations. The belts b may be of any suitable tough, flexible, wear-resistant material, such as steel alloy material used in the manufacture of heavy duty saw blades.

We claim:

1. A method of feeding strip material from an uncoiling or first apparatus station into a processing second apparatus station which comprises, maintaining a pair of continuous flexible belts in an aligning-guiding relation along opposite side edges of the strip material while positively advancing it from the first station into the second station, positively guiding the strip material between the belts while causing the belts to move forwardly in substantially synchronized engagement with opposite side edges of the strip material, and maintaining a wide side face of the pair of belts in an engaging relation along and with adjacent longitudinal side edges of the strip material during its advancing movement.

2. A method as defined in claim 1 wherein, the belts are maintained in freely moving engagement between the first and second stations with and along opposite side edges of the strip material by upper and lower and head and tail idler rollers, and the belts are maintained in engagement with the strip material lengthwise between the head and tail rollers.

3. A method as defined in claim 2 wherein the strip material is maintained in a substantially planar guided relation while it is being positively advanced between the stations.

4. Aligning apparatus for strip material that is being positively advanced endwise from one station into a processing second station from a coil of the material at one station which comprises, pairs of strip material guiding rolls operatively positioned in a planar pass supporting and guiding relation with the strip material during its advancing movement and in a transversely spaced-apart opposed relation with respect to each other for guiding the strip material in a substantially planar path between the two stations, a pair of longitudinally spaced-apart idler head and tail rollers operatively positioned along each side edge of the strip material, continuous alignment belts of flexible wear-resistant metal carried on said pairs of head and tail rollers and positioned in a side face to edge engaging relation along opposite side edges of the strip material between the stations, said alignment belts being adapted to be moved by and to positively guide the strip material during its advancing movement, and upper and lower idler guide rollers positioned along each of said alignment belts for maintaining one side face thereof in engagement with an adjacent side edge of the strip material.

5. Aligning apparatus for strip material that is being positively advanced endwise from one station into a processing second station which comprises, a pair of longitudinally spaced-apart head and tail rollers operatively positioned to extend perpendicular to and along a side edge of the strip material, continuous alignment belt means of flexible wear-resistant material carried on said pair of head and tail rollers, and bracket means positioning said pair of head and tail rollers to carry said belt in an aligning position along the side edge of the strip material for guiding engagement and movement therewith.

6. Aligning apparatus as defined in claim 5 wherein said bracket means has means for transversely adjusting its positioning with respect to the strip material to accommodate said belt means to different widths of strip material.

7. Aligning apparatus for strip material during its positive advancing movement endwise from one station into a processing second station which comprises, a pair of longitudinally spaced-apart head and tail rollers operatively positioned along opposite side edges of the strip material between said stations, a continuous belt of flexible wear-resistant material carried on each said pair of head and tail rollers, and said pairs of head and tail rollers operatively mounting said belts in an edge-aligning relation along the strip material between the stations for substantially synchronous movement with respect thereto during its endwise advancing movement.

8. Aligning apparatus as defined in claim 7 wherein bracket means is positioned along opposite sides of the strip material for positioning each said pair of head and tail rollers, and said bracket means has means for transversely adjusting the positioning of said head and tail rollers and the belts carried thereby with respect to the side edges of the strip material to accommodate said belts to different widths of the strip material.

9. Aligning apparatus as defined in claim 7 wherein said belts are operatively positioned for advancing movement with their wide side faces in engagement with opposite side edges of said strip material along the spacing between said head and tail rollers.

10. Aligning apparatus as defined in claim 7 wherein, upper and lower guide rollers are positioned in engagement with upper and lower edges of each of said alignment belts for maintaining them in position on each of said pair of head and tail rollers during advancing movement of said strip material.

11. Aligning apparatus as defined in claim 10 wherein, said pairs of head and tail and said upper and lower guide rollers are idler rollers, and each said belt is carried between said upper and lower guide rollers in such a manner that one of its side faces is maintained in guiding engagement with and along an adjacent side edge of the strip material to move therewith and guide its opposite side edges in an aligned entering relation into the second station.

12. Aligning apparatus as defined in claim 10 wherein, a support base is positioned along the path of movement of the strip material between the two stations, bracket means rotatably carries said rollers on said support base, and means is positioned on said support base for transversely adjustably mounting said bracket means thereon.

13. Aligning apparatus as defined in claim 10 wherein, each said belt is of continuous flexible metal construction and all of said rollers are idler rollers mounted to permit free movement of each of said belts thereon as induced by engagement of one side face of each of said belts with and along an adjacent side edge of the strip material during its advancing movement, and forward and return portions of said belts are carried between said pairs of head and tail rollers.

14. Aligning apparatus as defined in claim 10 wherein each pair of said upper and lower guide rollers is operatively positioned to engage and guide upper and lower edges of each of said belts.

15. Aligning apparatus as defined in claim 12 wherein strip material idler guide rollers are operatively carried on said support base to engage opposite side faces of the strip material and maintain it in a substantially planar relation during its advancing movement between the stations.

16. Aligning apparatus as defined in claim 15 wherein said strip material idler guide rolls comprise a first and second pair operatively carried on said support base to engage opposite side faces of the strip material in a transversely opposed and spaced-apart relation with respect to each other to guide the strip material in a substantially planar path of advancing movement between the stations.

* * * * *